US006441309B1

(12) United States Patent
Jow et al.

(10) Patent No.: US 6,441,309 B1
(45) Date of Patent: Aug. 27, 2002

(54) TREE RESISTANT CABLE

(75) Inventors: Jinder Jow, Somerville; Burkhard Eric Wagner, Highland Park; Gary Stanley Cieloszyk, Somerville, all of NJ (US)

(73) Assignee: Union Carbide Chemicals & Plastics Technology Corporation, Danbury, CT (US)

( * ) Notice: Subject to any disclaimer, the term of this patent is extended or adjusted under 35 U.S.C. 154(b) by 0 days.

(21) Appl. No.: 09/669,641

(22) Filed: Sep. 26, 2000

(51) Int. Cl.[7] ..... H01B 7/00
(52) U.S. Cl. ..... 174/110 R; 174/110 PM
(58) Field of Search ..... 174/110 R, 110 PM, 174/115 R, 36; 428/375, 378, 379, 395

(56) References Cited

U.S. PATENT DOCUMENTS

| | | | | | |
|---|---|---|---|---|---|
| 4,263,158 | A | * | 4/1981 | Ashcraft et al. | 252/573 |
| 4,814,135 | A | * | 3/1989 | Heitz | 264/230 |
| 4,894,284 | A | * | 1/1990 | Yamanouchi et al. | 428/378 |
| 4,988,783 | A | * | 1/1991 | Beran et al. | 526/129 |
| 4,997,713 | A | * | 3/1991 | Koehnlein et al. | 428/379 |
| 5,001,206 | A | * | 3/1991 | Bashir et al. | 264/177.13 |
| 5,180,889 | A | * | 1/1993 | Rogers et al. | 174/113 R |
| 5,211,746 | A | * | 5/1993 | Keogh et al. | 106/18.26 |
| 5,246,783 | A | * | 9/1993 | Spenadel et al. | 428/461 |
| 5,288,785 | A | * | 2/1994 | Jow et al. | 524/436 |
| 5,482,990 | A | * | 1/1996 | Jow et al. | 524/436 |
| 5,837,939 | A | * | 11/1998 | Cieloszyk et al. | 174/110 PM |

FOREIGN PATENT DOCUMENTS

| | | | |
|---|---|---|---|
| DE | 38 13 200 A1 | 11/1989 | C08L/23/06 |
| EP | 1 041 581 A1 | 10/2000 | H01B/3/44 |
| EP | 1 070 737 A1 | 1/2001 | C08K/5/00 |

OTHER PUBLICATIONS

The Condensed Chemical Dictionary, 10th Edition, Gessner Hawley, Copyright 1981, p. 831.*

Derwent Publications Ltd., London, GB; Class A14, AN 1992–272320 XP002191673 & JP 04 184810 A (Fujikura Ltd), Jul. 1, 1992 abstract.

Patent Abstracts of Japan, vol. 1995, No. 6, Jul. 31, 1995 & JP 07 065633 A (Fujikura Ltd), Mar. 10, 1995 abstract.

International Search Report dated Mar. 12, 2002 issued by the EPO acting as the International Searching Authority in PCT/US01/30215.

* cited by examiner

*Primary Examiner*—Dean A. Reichard
*Assistant Examiner*—William H. Mayo, III

(57) ABSTRACT

A cable having one or more electrical conductors or a core of electrical conductors, each conductor or core being surrounded by a layer of a composition having at least about 95 percent by weight of a very low density polyethylene (VLDPE) which has a number average molecular weight in the range of about 10,000 to about 20,000; a CHMS equal to or greater than about 4.5 percent by weight as determined by SEC; and a HMS having a number average molecular weight equal to or greater than about 500,000.

3 Claims, No Drawings

TREE RESISTANT CABLE

TECHNICAL FIELD

This invention relates to electric power cable insulated with a polyethylene composition having an improved resistance to water trees.

BACKGROUND INFORMATION

A typical electric power cable generally comprises one or more conductors in a cable core that is surrounded by several layers of polymeric material including a first semiconducting shield layer, an insulating layer, a second semiconducting shield layer, a metallic tape or wire shield, and a jacket.

These insulated cables are known to suffer from shortened life when installed in an environment where the insulation is exposed to water, e.g., underground or locations of high humidity. The shortened life has been attributed to the formation of water trees, which occur when an organic polymeric material is subjected to an electrical field over a long period of time in the presence of water in liquid or vapor form. The formation of water trees is believed to be caused by a complex interaction of the AC electrical field, moisture, time, and the presence of ions. The net result is a reduction in the dielectric strength of the insulation.

Many solutions have been proposed for increasing the resistance of organic insulating materials to degradation by water treeing. One solution involves the addition of polyethylene glycol, as a water tree growth inhibitor, to a low density polyethylene made by a high pressure process. This solution has been applied for many years; however, there is a continuous industrial demand for improvement with respect to four features, i.e., tree retardancy, processability, peroxide response, and flexibility.

DISCLOSURE OF THE INVENTION

An object of this invention, therefore, is to provide a cable based on a polyethylene composition, which does provide improvement in the four features mentioned above. Other objects and advantages will become apparent hereinafter.

According to the invention, a cable has been discovered which meets the above object.

The cable comprises one or more electrical conductors or a core of electrical conductors, each conductor or core being surrounded by a layer of a composition comprising at least about 95 percent by weight of a very low density polyethylene (VLDPE) having a density in the range of 0.860 to 0.915 gram per cubic centimeter, said VLDPE having a number average molecular weight in the range of about 10,000 to about 20,000 and a CHMS equal to or greater than about 4.5 percent by weight as determined by SEC.

CHMS=Concentration of High Molecular Weight Species. The High Molecular Weight Species (HMS) of the CHMS has a number average molecular weight equal to or greater than about 500,000.

SEC=Size Exclusion Chromatography.

DESCRIPTION OF THE PREFERRED EMBODIMENT(S)

The very low density polyethylene (VLDPE) is a linear copolymer of ethylene and one or more alpha-olefins having 3 to 12 carbon atoms, and preferably 4 to 8 carbon atoms, and, optionally, a diene. Examples of the alpha-olefins are propylene, 1-butene, 1-hexene, 4-methyl-1-pentene, and 1-octene.

The VLDPE can be homogeneous or heterogeneous. The homogeneous VLDPEs have an essentially uniform comonomer distribution, and are characterized by single and relatively low DSC melting points. The heterogeneous VLDPEs, on the other hand, do not have a uniform comonomer distribution. The VLDPEs can have a density in the range of 0.860 to 0.915 gram per cubic centimeter, and preferably have a density in the range of 0.880 to 0.910 gram per cubic centimeter.

The VLDPEs are generally produced by low pressure processes. They are preferably produced in the gas phase, but they can also be produced in the liquid phase in solutions or slurries by conventional techniques. Low pressure processes are typically run at pressures below 1000 psi.

Catalyst systems which can be used to prepare these VLDPE resins can be magnesium/titanium or vanadium-based systems; chrome-based systems; or metallocene systems. The chief requirement for these catalysts is that they can produce resins having the required molecular architecture, molecular weight, and density. These resins can be produced in either two or more reactors featuring the required process conditions to generate the main body of the resin in one reactor, and the high molecular weight tail in another reactor. In the case of this multistage polymerization system, a wide range of catalysts can be used. Magnesium/titanium based catalyst systems can be exemplified by the catalyst system described in U.S. Pat. No. 4,302,565 (heterogeneous polyethylenes); vanadium based catalyst systems by those described in U.S. Pat. No. 4,508,842 (heterogeneous polyethylenes) and U.S. Pat. Nos. 5,332,793; 5,342,907; and 5,410,003 (homogeneous polyethylenes); a chromium based catalyst system by that described in U.S. Pat. No. 4,101,445; a metallocene catalyst system by those described in U.S. Pat. Nos. 4,937,299 and 5,317,036 (homogeneous polyethylenes); or other transition metal catalyst systems. Many of these catalyst systems are often referred to as Ziegler-Natta catalyst systems or Phillips catalyst systems. Catalyst systems, which use chromium or molybdenum oxides on silica-alumina supports, can be included here. Typical processes for preparing the VLDPEs are also described in the aforementioned patents.

In the case of polymerization in a single reactor, catalysts may be used giving rise to two intimately mixed populations of resins whose sum produces the resin of the current invention. One suitable catalyst system is a silica-supported magnesium/titanium catalyst available from Grace Davison under the designation of Sylopol™ 5950, which produces suitable resins when polymerized in the presence of a mild aluminum alkyl cocatalyst such as tri-n-hexyl aluminum or tri-isobutyl aluminum at about a 30:1 Al/Ti weight ratio.

The melt index of the VLDPE can be in the range of about 0.1 to about 20 grams per 10 minutes and is preferably in the range of about 0.3 to about 5 grams per 10 minutes. The portion of the VLDPE attributed to the comonomer(s), other than ethylene, can be in the range of about 1 to about 49 percent by weight based on the weight of the copolymer and is preferably in the range of about 15 to about 40 percent by weight. A third comonomer can be included, e.g., another alpha-olefin or a diene such as ethylidene norbornene, butadiene, 1,4-hexadiene, or a dicyclopentadiene. The third comonomer can be present in an amount of about 1 to 15 percent by weight based on the weight of the copolymer and is preferably present in an amount of about 1 to about 10 percent by weight. It is preferred that the copolymer contain two or three comonomers inclusive of ethylene.

It will be understood that, if one or more additional resins are introduced into the composition, the amount of the additional resins will either make up the about 5 percent by weight balance or will be based on 100 parts by weight of the VLDPE. These resins can be various polyethylenes (low, medium, or high density) or polypropylenes, or other polymer additives conventionally used in wire and cable applications.

As noted, the polyethylene composition, which is used in the cable of the invention, comprises at least about 95 percent by weight of VLDPE having a number average molecular weight in the range of about 10,000 to about 20,000 and a CHMS equal to or greater than about 4.5 percent by weight as determined by SEC. HMS has a number average molecular weight equal to or greater than about 500,000, preferably in the range of about 500,000 to about 2,000,000. In order to provide the conventional molecular weight together with the high molecular weight tail in fully commingled form, the VLDPE can be prepared, as noted above, with a silica supported magnesium/titanium catalyst preactivated with an aluminum alkyl using the following steps and conditions:

An 8-inch gas phase fluid bed reactor of reaction volume 50 liters, which is capable of polymerizing olefins at a rate of 5 to 7 pounds per hour at 300 psi (pounds per square inch) pressure, is used. Reaction conditions for the VLDPE are: reaction temperature 60 degrees C; 56 psi ethylene; hydrogen/ethylene weight ratio=0.35; and 1-butene/ethylene weight ratio=0.36. A 5 pound startup bed of resin nominally identical to the resin to be produced is employed. Polymerization is conducted at a productivity of 2,200 pounds of polyethylene per pound of catalyst. The catalyst precursor employed is Grace Davison Sylopol™ 5950, a silica-supported magnesium/titanium catalyst with nominal titanium content of 0.7 weight percent titanium. The cocatalyst is tri-n-hexyl aluminum employed at a 30:1 Al/Ti weight ratio. The obtained resin has less than about 0.05 weight percent ash.

Conventional additives, which can be introduced into the polyethylene formulation, are exemplified by antioxidants, coupling agents, ultraviolet absorbers or stabilizers, antistatic agents, pigments, dyes, nucleating agents, reinforcing fillers or polymer additives, slip agents, plasticizers, processing aids, lubricants, viscosity control agents, tackifiers, anti-blocking agents, surfactants, extender oils, metal deactivators, voltage stabilizers, flame retardant fillers and additives, crosslinking agents, boosters, and catalysts, and smoke suppressants. Fillers and additives can be added in amounts ranging from less than about 0.1 to about 5 parts by weight for additives other than fillers and to more than about 200 parts by weight for fillers, all for each 100 parts by weight of the base resin, in this case, VLDPE.

Examples of antioxidants are: hindered phenols such as tetrakis [methylene (3,5-di-tert- butyl-4-hydroxyhydrocinnamate)]methane, bis [(beta- (3,5-ditert-butyl-4-hydroxybenzyl)methylcarboxyethyl)]sulphide, and thiodiethylene bis(3,5-di-tert-butyl-4-hydroxy) hydrocinnamate; phosphites and phosphonites such as tris (2,4-di-tert-butylphenyl)phosphite and di-tert-butylphenyl-phosphonite; thio compounds such as dilaurylthiodipropionate, dimyristylthiodipropionate, and distearylthiodipropionate; various siloxanes; and various amines such as polymerized 2,2,4-trimethyl-1,2-dihydroquinoline and diphenylamines. Antioxidants can be used in amounts of about 0.1 to about 5 parts by weight per 100 parts by weight of VLDPE.

The VLDPE or other resins introduced into the composition of the invention can be crosslinked by adding a crosslinking agent to the composition or by making the resin hydrolyzable, which is accomplished by adding hydrolyzable groups such as —$Si(OR)_3$ wherein R is a hydrocarbyl radical to the resin structure through grafting. It is preferred that the resin be crosslinked and that it be crosslinked with an organic peroxide. Crosslinking can also be effected by irradiation, if desired.

The crosslinking of polymers with free radical initiators such as organic peroxides is well known. Generally, the organic peroxide is incorporated into the polymer by melt blending in a roll mill, a biaxial screw kneading extruder, or a Banbury™ or Brabender mixer at a temperature lower than the onset temperature for significant decomposition of the peroxide. Peroxides are judged for decomposition based on their half life temperatures as described in Plastic Additives Handbook, Gachter et al, 1985, pages 646 to 649. An alternative method for organic peroxide incorporation into a polymeric compound is to mix liquid peroxide and pellets of the polymer in a blending device, such as a Henschel™ mixer or a soaking device such as a simple drum tumbler, which are maintained at temperatures above the freeze point of the organic peroxide and below the decomposition temperature of the organic peroxide and the melt temperature of the polymer. Following the organic peroxide incorporation, the polymer/organic peroxide blend is then, for example, introduced into an extruder where it is extruded around an electrical conductor at a temperature lower than the decomposition temperature of the organic peroxide to form a cable. The cable is then exposed to higher temperatures at which the organic peroxide decomposes to provide free radicals, which crosslink the polymer.

Suitable crosslinking agents are organic peroxides such as dicumyl peroxide; 2,5-dimethyl-2,5-di(t-butylperoxy) hexane; t-butyl cumyl peroxide; and 2,5-dimethyl-2,5-di(t-butylperoxy)hexane-3. Dicumyl peroxide is preferred.

Hydrolyzable groups can be added, for example, by grafting an ethylenically unsaturated compound having one or more —$Si(OR)_3$ groups such as vinyltrimethoxysilane, vinyltriethoxysilane, and gamma-methacryloxypropyltrimethoxy-silane to the homopolymer in the presence of the aforementioned organic peroxides. The hydrolyzable resins are then crosslinked by moisture in the presence of a silanol condensation catalyst such as dibutyltin dilaurate, dioctyltin maleate, dibutyltin diacetate, stannous acetate, lead naphthenate, and zinc caprylate. Dibutyltin dilaurate is preferred.

Examples of hydrolyzable grafted copolymers are vinyltrimethoxy silane grafted ethylene homopolymer, vinyltriethoxy silane grafted ethylene homopolymer, and vinyltributoxy silane grafted ethylene homopolymer.

A cable using the composition of the invention can be prepared in various types of extruders, e.g., single or twin screw types. Compounding can be effected in the extruder or prior to extrusion in a conventional mixer such as a Brabender™ mixer or a Banbury™ mixer. A description of a conventional extruder can be found in U.S. Pat. No. 4,857,600. A typical extruder has a hopper at its upstream end and a die at its downstream end. The hopper feeds into a barrel, which contains a screw. At the downstream end, between the end of the screw and the die, is a screen pack and a breaker plate. The screw portion of the extruder is considered to be divided up into three sections, the feed section, the compression section, and the metering section, and two zones, the back heat zone and the front heat zone, the sections and zones running from upstream to downstream. In the alternative, there can be multiple heating zones (more than two) along the axis running from upstream to downstream. If it has more than one barrel, the barrels are connected in series. The length to diameter ratio of each barrel is in the range of about 15:1 to about 30:1. In wire coating, where the material is crosslinked with an organic peroxide after extrusion, the die of the crosshead feeds directly into a heating zone, and this zone can be maintained at a temperature in the range of about 130° C. to about 260° C., and preferably in the range of about 170° C. to about 220° C.

One of the advantages of the invention lies in that commercially acceptable water tree retardance can be achieved without additives, i.e., the VLDPE used in this invention is inherently water tree retardant. Additional advantages are that the VLDPE is both inherently flexible and inherently easily processable. In addition, the VLDPE has good peroxide response.

The term "surrounded" as it applies to a substrate being surrounded by an insulating composition, jacketing material, or other cable layer is considered to include extruding around the substrate; coating the substrate; or wrapping around the substrate as is well known by those skilled in the art. The substrate can include, for example, a core including a conductor or a bundle of conductors, or various underlying cable layers as noted above.

All molecular weights mentioned in this specification are number average molecular weights unless otherwise designated.

The patents, patent application, and publication mentioned in this specification are incorporated by reference herein.

The invention is illustrated by the following examples.

EXAMPLES 1 to 4

Water tree growth resistance (WTGR) is determined under ASTM D-6097-97 at room temperature, 5 kiloVolts, and one kiloHerz for 30 days in 0.01 Normal salt water. WTGR is assessed by the average water tree length reported in millimeters, the shorter tree length indicating better WTGR. The typical average tree length of Composition A, a commercial tree retardant crosslinked polyethylene prepared by a conventional high pressure process containing a tree retardant additive is about 0.23 millimeter. The typical standard deviation of tree measurement is about 0.05 millimeter. Density is measured in gram per cubic centimeter with a density column according to ASTM D-792. The typical standard deviation of density measurement is about 0.003 gram per cubic centimeter. CHMS (Concentration of High Molecular Weight Species) is measured by Size Exclusion Chromatography (SEC).

The following four compositions are tested for WTGR:

1. Composition A contains 100 parts by weight of a homopolymer of ethylene prepared by a conventional high-pressure process. It has a density of 0.920 gram per cubic centimeter and a melt index of 2.1 grams per 10 minutes, and is crosslinked. It also contains 0.36 part by weight of an antioxidant.

2. Composition B is the same as Composition A except that it contains 0.6 part by weight polyethylene glycol (PEG) having a weight average molecular weight of 20,000 as a tree retardant additive.

3. Composition C contains 100 parts by weight of VLDPE prepared with a conventional magnesium/titanium catalyst in a single-stage gas phase polymerization process similar to that described in U.S. Pat. No. 4,302,565. The VLDPE has a density of 0.899 gram per cubic centimeter and a melt index of 5 grams per 10 minutes. It also has a high molecular weight tail with a CHMS equal to 0.9 percent by weight as determined by SEC. The CHMS is defined as the percentage concentration by weight for the number average molecular weight greater than about 500,000. Composition C also contains 0.36 part by weight of an antioxidant. The VLDPE is crosslinked.

4. Composition D contains 100 parts by weight of VLDPE having a density of 0.903 gram per cubic centimeter and a melt index of 1.4 grams per 10 minutes. The VLDPE has a high molecular weight tail with a CHMS equal to about 4.7 percent by weight as determined by SEC. The VLDPE is prepared as set forth above in a gas phase polymerization process with the catalyst Grace Davison Sylopol™ 5950 described, and is crosslinked. Composition D also contains 0.36 part by weight of an antioxidant.

Composition A is a high-pressure processed LDPE (low density polyethylene) which does not have a tree retardant additive, and has unacceptable tree retardance. Composition B is the current industry standard using a tree retardant additive in Composition A to improve tree retardance. Composition C is a conventional low-pressure processed VLDPE which shows improved tree retardance when compared with Composition A but is still inferior to Composition B. Composition D, an embodiment of the resin used in subject invention, is a low pressure processed VLDPE with a high molecular weight tail. It exhibits a tree retardance better than Composition B. The results are shown in the following Table.

The Table also lists several means of describing the skewness (lack of symmetry) of the molecular weight distribution of the VLDPE used in subject invention. Relevant indicators of average molecular weight are weight average molecular weight (Mw), number average molecular weight (Mn), and "z-average" molecular weight (Mz), which accentuates the high molecular weight components in the resin although it is a number average molecular weight.. The ratios of these average molecular weights are indicators of the molecular weight distribution. The ratio of melt index to flow index of the resin is also used as an indicator of molecular weight. Three of the most common ones are the polydispersity index (PDI), also known as Mw/Mn; the ratio of z average molecular weight to weight average molecular weight, Mz/Mw; and the distribution obtained from the ratio of melt index to flow index, i.e., the melt flow ratio. In all of these ratios, a higher value indicates a broader and a more skewed molecular weight distribution. (See S. R. Rafikov, S. A. Pavlova, and I.I. Tverdokhlebova, *Determination of Molecular Weights and Polydispersity of High Polymers*, Daniel Davey & Co, Inc., New York, N.Y. 1964, Chapter 1). Melt index (MI or $I^{2.1}$) is determined under ASTM D-1238, Condition E. It is measured at 190 degrees C. and 2.16 kilograms, and reported in grams per 10 minutes. Flow index (FI or $I^{21}$) is determined under ASTM D-1238, Condition F. It is measured at 190 degrees C. and 21.6 kilograms, and reported in grams per 10 minutes. Melt flow ratio (MFR or $I^{21}/I^{2.1}$) is the ratio of flow index to melt index.

| Examples | 1 | 2 | 3 | 4* |
|---|---|---|---|---|
| Composition | A | B | C | D |
| Mn | 20,000 | 20,000 | 17,000 | 15,500 |
| Mw | 135,000 | 135,000 | 697,000 | 118,000 |
| Mz (or HMS) | 526,000 | 526,000 | 203,000 | 588,000 |
| CHMS (%) | 4.2 | 4.2 | 0.9 | 4.7 |
| WTGR (mm) | 0.512 ± 0.090 | 0.230 ± 0.050 | 0.290 ± 0.065 | 0.210 ± 0.060 |
| MFR ($I_{21}/I_2$) | 56 | 56 | 34 | 62 |

-continued

| Examples | 1 | 2 | 3 | 4* |
|---|---|---|---|---|
| PDI | 6.8 | 6.8 | 4.1 | 7.6 |
| Mz/Mn | 3.9 | 3.9 | 2.9 | 5.0 |

*Example 4 is an emhodiment of the invention.

What is claimed is:

1. A cable comprising one or more electrical conductors or a core of electrical conductors, each conductor or core being surrounded by a layer of a composition comprising at least about 95 percent by weight of a very low density polyethylene (VLDPE) having a number average molecular weight in the range of about 10,000 to 20,000; a concentration of high molecular weight species (CHMS) equal to or greater than about 4.5 percent by weight as determined by a size exclusion chromatography (SEC); and a high molecular weight species (HMS) having a number average molecular weight equal to or greater than about 500,000.

2. The cable defined in claim 1, wherein the concentration of high molecular weight species (CHMS) fraction is a high molecular weight tail having a molecular weight in the range of about 500,000 to about 2,000,000.

3. A cable comprising one or more electrical conductors or a core of electrical conductors, each conductor or core being surrounded by a layer of a composition comprising at least about 95 percent by weight of a very low density polyethylene (VLDPE) having a density in the range of 0.870 to 0.915 gram per cubic centimeter, said very low density polyethylene (VLDPE) having number average molecular weight in the range of about 10,000 to 20,000; a concentration of high molecular weight species (CHMS) equal to or greater than about 4.5 percent by weight as determined by a size exclusion chromatography (SEC); and a high molecular weight species (HMS) having a number average molecular weight equal to or greater than about 500,000.

* * * * *